US005741087A

United States Patent [19]

Osadchuk

[11] Patent Number: 5,741,087

[45] Date of Patent: Apr. 21, 1998

[54] CHAIN SEPARATOR FOR PADDING MACHINE

[76] Inventor: Mark Osadchuk, 10040 Happy Valley Rd., Scottsdale, Ariz. 85255

[21] Appl. No.: 735,905

[22] Filed: Oct. 24, 1996

Related U.S. Application Data

[63] Continuation of Ser. No. 693,720, Aug. 5, 1996.

[51] Int. Cl.[6] ..... B07B 13/0414; E02F 5/2226

[52] U.S. Cl. ..... 405/179; 37/142.5; 209/257

[58] Field of Search ..... 405/179; 37/142.5; 209/235, 257

[56] References Cited

U.S. PATENT DOCUMENTS

| | | | |
|---|---|---|---|
| 1,276,903 | 8/1918 | Green . | |
| 1,440,232 | 12/1922 | Muir . | |
| 1,690,009 | 10/1928 | Hamilton . | |
| 1,792,148 | 2/1931 | Dobbins et al. . | |
| 2,296,851 | 9/1942 | Henry . | |
| 2,300,017 | 10/1942 | Shaffer . | |
| 2,453,714 | 11/1948 | Lapointe . | |
| 2,553,072 | 5/1951 | Zeh et al. . | |
| 2,598,223 | 5/1952 | Chase . | |
| 2,696,287 | 12/1954 | Foust . | |
| 2,734,730 | 2/1956 | Talboys . | |
| 2,744,739 | 5/1956 | Evans et al. . | |
| 2,814,387 | 11/1957 | McWilliams . | |
| 2,857,691 | 10/1958 | Curran . | |
| 3,316,977 | 5/1967 | Snook . | |
| 3,439,806 | 4/1969 | Kass et al. . | |
| 3,442,381 | 5/1969 | Johnson . | |
| 3,998,396 | 12/1976 | Umphrey et al. | 241/81 |
| 4,221,505 | 9/1980 | Taylor-Smith | 405/303 |
| 4,277,105 | 7/1981 | Taylor | 299/64 |
| 4,363,725 | 12/1982 | Morita et al. | 209/257 |
| 4,632,751 | 12/1986 | Johnson et al. | 209/326 |
| 4,633,602 | 1/1987 | Layh et al. | 37/195 |
| 4,795,552 | 1/1989 | Yun et al. | 209/319 |
| 4,912,862 | 4/1990 | Bishop et al. | 37/142.5 |
| 4,944,108 | 7/1990 | George et al. | 43/6.5 |
| 4,948,299 | 8/1990 | Cronk, Jr. et al. | 405/179 |
| 5,084,991 | 2/1992 | Cronk, Jr. et al. | 37/142.5 |
| 5,097,610 | 3/1992 | Bishop | 37/142.5 |
| 5,120,433 | 6/1992 | Osadchuk | 209/235 |
| 5,195,260 | 3/1993 | Osadchuk | 37/142.5 |
| 5,261,171 | 11/1993 | Bishop | 37/142.5 |
| 5,421,108 | 6/1995 | Stewart | 37/142.5 |

FOREIGN PATENT DOCUMENTS

| | | |
|---|---|---|
| 85-235043/38 | 2/1985 | U.S.S.R. . |
| 2219330 | 5/1989 | United Kingdom . |

*Primary Examiner*—Tamara L. Graysay
*Assistant Examiner*—Tara L. Mayo
*Attorney, Agent, or Firm*—Crutsinger & Booth

[57] ABSTRACT

A padding apparatus for padding underground cable or pipeline is provided. The padding apparatus is adapted to continuously separate excavated material piled alongside an excavated ditch into relatively fine padding material and relatively rough residual material as the apparatus moves forward. The padding apparatus continuously places the relatively fine padding material in the ditch. According to the invention, the apparatus includes a frame for supporting and moving an endless openwork in an endless path for lifting excavated material in an elevating direction. The endless openwork has rods and transverse chain sections attached to the rods, whereby the rods and chain sections define openings that allow relatively fine padding material to pass therethrough. A discharge conveyor is positioned beneath at least a portion of the endless openwork of the separator to receive the relatively fine padding material and convey the padding material to the ditch for padding cable or pipeline therein.

26 Claims, 10 Drawing Sheets

CHAIN SEPARATOR FOR PADDING MACHINE

This is a continuation of application Ser. No. 08/693,720 filed Aug. 5, 1996.

TECHNICAL FIELD

This invention relates to padding machines that are useful for burying underground cables and pipelines. A padding machine continuously moves alongside an excavated ditch, elevates excavated material, separates relatively fine padding material from relatively rough material that could damage a cable or pipeline, and transports the padding material into the ditch for padding the cable or pipeline. More particularly, the invention relates to a new chain separator for a padding machine to increase the amount of relatively fine padding material separated from the excavated material.

BACKGROUND OF THE INVENTION

Underground cables and pipelines are typically emplaced by laying the cable or pipeline in a prepared trench and subsequently backfilling the trench.

Some cables and pipelines are susceptible to damage from stones, rocks, or other hard objects in the backfill material. For example, optical fiber communications cables are considered particularly susceptible to damage in this manner, as are polymeric or plastic pipelines. Also steel pipes are increasingly provided with protective polymeric coatings, which must be protected from penetration or damage by hard objects.

Consequently, in the laying of cables and pipelines it is increasingly sought to backfill the trench with fill material that is free of stones or other hard objects. One way to achieve this is to backfill the trench with sand or other suitable fill material brought from a remote source of sand or rock-free soil. This approach is expensive and time-consuming. Further, where steel pipe is protectively padded with a layer of sand, the filled trench collects standing water in the porous sand fill, leading to premature corrosion of the pipe. Also, the use of a fill material that is different from the surrounding soil results in a loss of cathodic protection, which leads to premature corrosion of steel pipe.

The alternative is to screen the excavated material dug from the trench, to remove stones and other foreign objects, and return the screened material to the trench. Several machines, known as padding machines, have been disclosed in the prior art for this purpose.

For example, U.S. Pat. No. 2,857,691 to Curran discloses a tracked vehicle having a vertically swingable boom that extends laterally over a trench. The boom includes a tube having an enclosed auger. At the far end of the boom from the vehicle is a rotating head which scoops up soil from alongside the trench, screens the soil, and transmits it to the auger, which conveys the screened soil along the tube and into the trench through openings in the tube. The Curran apparatus is particularly designed for use with a vehicle driven along the opposite side of a trench from the pile of soil that was removed from the trench and which extends alongside the trench. A major disadvantage of the Curran device is that since the rotating head is attached with boom extending to the side of the tracked vehicle across the ditch, the operation of the rotating head on the far side of the ditch is difficult or impossible to control. Another major disadvantage is that the device occupies both sides of the ditch, causing increased traffic congestion along the narrow right of way of the pipeline.

U.S. Pat. No. 4,633,602, to Layh et al., is an important advance in the pipeline padding art. Layh et al. discloses a pipeline padding machine that operates on one side of the ditch in the excavated material pile. Layh et al. shows the use of a pipeline padding machine having a gathering head for collecting excavated material, an elevator for moving collected excavated material upwardly and rearwardly to dump the material onto a flat separator screen. Fine material falls through the separator screen onto a lateral conveyor for transporting the fine padding material to the ditch. The angle or tilt of the separator can be adjusted to compensate the angle of upward and downward slopes and the type of excavated material to adjust the amount of padding material separated from the excavated material. The rough material is placed behind the padding machine. The separator screen can be vibrated to increase the amount of fines passed through the separator. This device does not provide for screening during the initial conveying nor for attachment to vehicles, such as loaders and bulldozers.

U.S. Pat. Nos. 5,120,433 and 5,195,260 issued to Mark Osadchuk, disclose significantly improved pipeline padding machines of the general type disclosed in U.S. Pat. No. 4,633,602 to Layh et al. The Layh et al. and Osadchuk patents are generally large machines, which are intended and useful primarily for long-distance pipe laying operations in open country, where rights of way are relatively wide and the terrain is not excessively rugged.

U.S. Pat. Nos. 5,097,610 and 5,261,171 issued to Bishop disclose a pipeline padding machine attachment. The Bishop padding machine attachment is removably attached to one end of a vehicle, such as a bucket loader, bulldozer, or other base machine, whereby the attachment moves along the path of travel of the vehicle. The padding machine attachment picks up at least a portion of a pile of excavated material along side the ditch and processes the excavated material into padding material for placement into the ditch for padding a cable or pipeline. However, an improved separator belt that is less likely to become clogged with clay or mud is desirable for the Bishop padding machine attachment.

U.S. Pat. No. 5,084,991 issued to Cronk, Jr. on Feb. 4, 1992, discloses a pipeline padding apparatus having a generally box-shaped frame supporting a separating drum. The separating drum has first and second outside ring members and a center ring member. A plurality of elongated parallel rods are spaced around and attached to the circumference of the first, second, and center ring members to perform a separating function. However, the spaced-apart parallel rods do not provide a mesh structure that uniformly limits the overall size of material that can pass through the rods. If a screen mesh is bolted to the drum, the screens, which are not vibrated, have a tendency to become clogged with clay or mud.

Increasing the ability of a padding machine to separate padding material from excavated material and reducing the tendency of the separator screen to become clogged with clay or mud is desirable. There has been a particularly long-felt need to increase this ability for small pipeline padding machines or attachments, which have the advantage of versatility and lower cost, but suffer from the disadvantage of inadequate padding material output for larger padding operations.

SUMMARY OF THE INVENTION

A padding apparatus for padding underground cable or pipeline is provided. The padding apparatus is adapted to continuously separate excavated material piled alongside an excavated ditch into relatively fine padding material and relatively rough residual material as the apparatus moves forward. The padding apparatus continuously places the relatively fine padding material in the ditch. According to the invention, the apparatus includes a frame for supporting and moving an endless openwork in an endless path for lifting excavated material in an elevating direction. The endless openwork has rods and transverse chain sections attached to the rods, whereby the rods and chain sections define openings that allow relatively fine padding material to pass therethrough. A discharge conveyor is positioned beneath at least a portion of the endless openwork of the separator to receive the relatively fine padding material and convey the padding material to the ditch for padding cable or pipeline therein.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF PREFERRED EMBODIMENTS OF THE INVENTION

Figure 1:
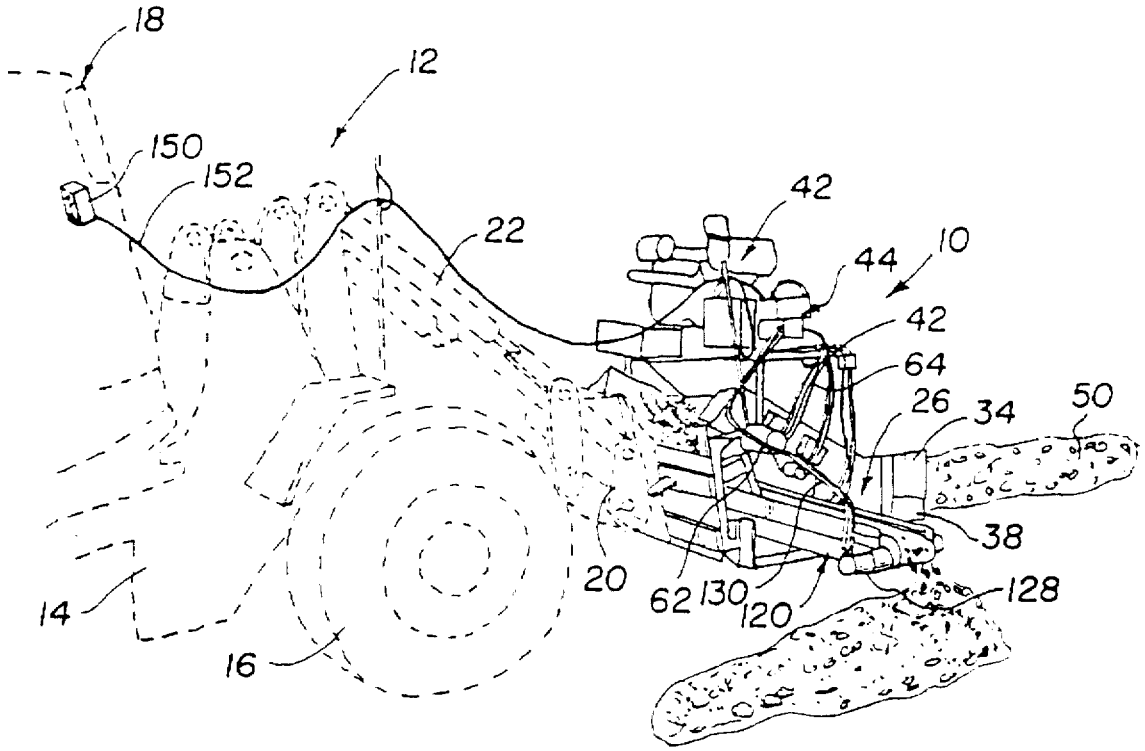
FIG. 1 is a perspective view from the side of a padding machine according to a preferred embodiment of the invention, which is a removable attachment for a vehicle, such as a front-end loader.
Figure 2:
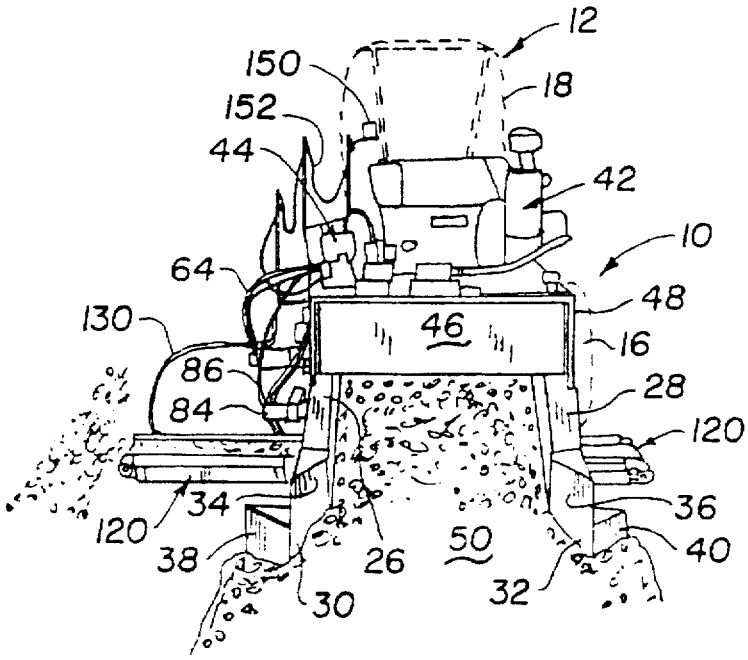
FIG. 2 is a front end view of the padding machine shown in FIG. 1 shown operating in a pile of excavated material.

Referring to FIGS. 1 and 2, there is illustrated a padding machine 10, which is one presently most preferred embodiment of the present invention. The padding machine 10 is preferably an attachment for a vehicle, such as a front-end loader, bulldozer, or other vehicle capable of moving in a pile of excavated material.

The padding machine 10 is an improvement of the padding machine attachment shown in U.S. Pat. Nos. 5,097,610 and 5,261,171 to Bishop, the disclosures of which are incorporated herein by reference in their entirety. However, it is to be understood that the improved separator assembly disclosed herein can be used in a padding machine attachment of the type disclosed in U.S. Pat. No. 5,084,991 issued to Cronk, Jr. on Feb. 4, 1992, the disclosure of which is incorporated herein by reference in its entirety. It also is to be understood that the improved separator assembly disclosed herein can be used in self-contained padding machines such as those disclosed in the Lay et al. and Osadchuk patents discussed above.

As shown in FIGS. 1 and 2, the vehicle is represented by a front-end loader 12, which is shown in phantom lines. The front-end loader 12 has a base frame 14, tires 16, and an operator cab 18. A sub-frame 20 is pivotally attached to the vehicle base frame 14 at the front end of the vehicle 12. The sub-frame 20 can be selectively raised and lowered by a pair of piston-cylinder units 22. Normally, the sub-frame 20 of the front-end loader 12 has a bucket removably attached thereto. The bucket can be easily removed to facilitate attachment of the padding machine 10 to the sub-frame 20. Alternatively, the padding machine 10 can be hooded onto the bucket as previously described in U.S. Pat. Nos. 5,097,610 and 5,261,171 to Bishop. Thus, the vehicle 12 can be used for at least two different purposes, for example, as a front-end loader or as the prime mover for the padding machine 10.

The basic structure and operation of the padding machine 10 will be described first, and then the improved separator according to the presently most preferred embodiment of the invention will be described in detail.

As shown in the overview of the padding machine 10 shown in FIGS. 1 and 2, it includes an angular frame 24. The angular frame 24 includes a pair of triangular side frame members 26 and 28. The side frame members 26 and 28 are connected by several cross members, including several bottom frame members or a solid plate, or a rear cross plate, and can include optional reinforcing members, cross bars, or safety bars. Additionally, the padding machine 10 includes a lip or blade that spans and connects the side frame members 26 and 28 at the forward end of the machine 10, and which is positioned to be located at ground level and to function as a cutting blade when the machine 10 is in operation.

Figure 3:
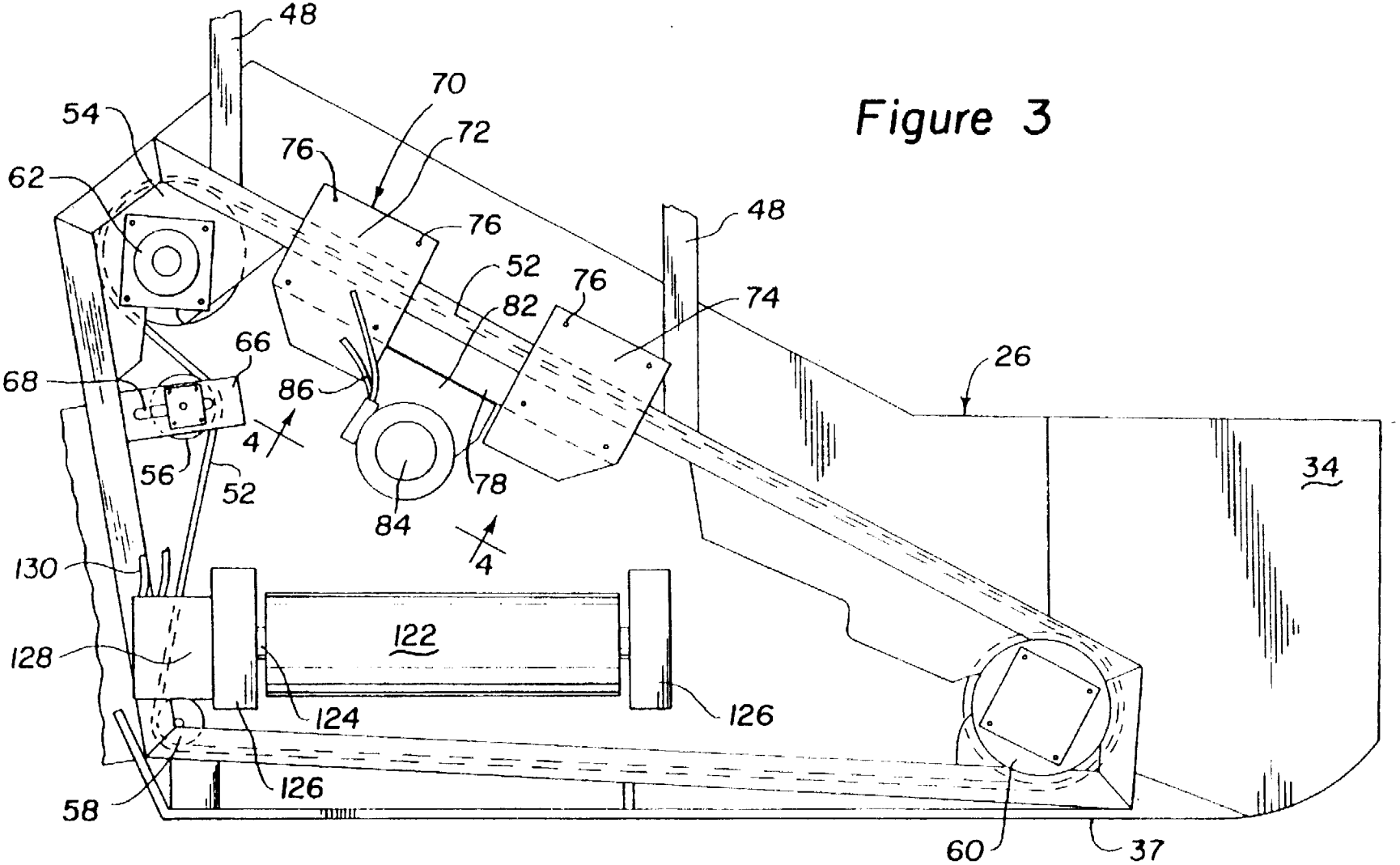
FIG. 3 is a side elevation view of a side frame member of a padding machine according to FIGS. 1 and 2 showing the attachment of an endless separator and shaker assembly to the frame member.

The side frame members 26 and 28 further include outwardly disposed guide projections 30 and 32 at their lower front ends, which function to collect and guide excavated material toward the center of the machine 10. These guide projections 30 and 32 are preferably unitarily formed with the side frame members 26 and 28. The guide projections 30 and 32 flare outwardly from a center line that would bisect the padding machine 10. Each of the guide projections 30 and 32 include a ground engaging lower surface formed to be substantially parallel to the surface upon which the vehicle 12 rests. The guide projections 30 and 32 include upwardly extending side guard portions 34 and 36, respectively. The side guard portions 34 and 36 help prevent excavated material from spilling over the guide projections 30 and 32, which might otherwise result in excavated material or rough material falling into the ditch and damages a cable or pipeline laid therein. Turning briefly ahead to FIG. 3 of the drawing, the bottom of the side members 26 and 28 have a smooth ground engaging lower surface 37 for skidding along the ground or the pile of excavated material 50.

Outwardly extending wing portions 38 and 40 are rigidly attached to the guide projections 30 and 32, respectively. Wing portions 38 and 40 are designed to clear a path behind the padding machine for the tires or tracks of the vehicle 12. The smoothed out surface provides a stable surface upon which the vehicle 12 can ride. This helps the vehicle 12 to negotiate its way in or through the pile of excavated material and to control the depth of cut of the padding machine 10, which is a factor affecting how much padding material is obtained.

A diesel engine 42, hydraulic system 44, and hydraulic fluid reservoir 46 are supported by an overhead structural support 48 in a location that is elevated above the rest of the padding machine 10. By placing the engine 42 above the rest of the padding machine, the amount of dust and dirt that it is exposed to during operating of the padding machine 10 is greatly reduced. The weight of the engine 42, hydraulic system 44, and the hydraulic fluid reservoir 46 also serves to help force the padding machine to bite into a pile of excavated material 50 and gather the material between the guide projections 30 and 32.

As best shown in FIG. 3, the padding machine 10 further includes a separator 52. According to the presently most preferred embodiment of the invention, the separator 52 is in the form of an endless path separator. If desired, the separator 52 can have a number of raised flights (not shown), which function to assist in scooping earth onto the separator 52. The separator 52 provides a framework or openwork with a plurality of openings selectable to be of a size for processing excavated material while permitting the passage through the openings of suitable pipeline or cable padding material and rejecting the passage of all other material as residual material. The structure of the separator 52 according to the presently most preferred embodiment of the invention will hereinafter be described in detail.

According to the presently most preferred embodiment of the invention, the separator 52 is mounted to travel over a plurality of rollers, such as the drive roller 54 that is located at the top and rear of the frame members 26 and 28, tension roller 56 located beneath and slightly forward of the drive roller 50, rearward, lower roller 58 located at the rearward, lower corner of the frame members 26 and 28, and forward, lower roller 60 located at the forward, lower end of the frame members 26 and 28. The rollers 54, 56, 58, and 60 are all journaled in associated bearings mounted on the side frame members 26 and 28. It is to be understood, of course, the fewer or additional rollers can be used in the invention.

The drive roller 54 is driven by a motor, such as hydraulic motor 62 mounted on the side frame member 26. The hydraulic motor 62 is connected to the drive roller 54 by conventional means. As shown in FIGS. 1 and 2, the hydraulic motor 62 is connected through hydraulic hoses 64 to the hydraulic system 44. Thus, the hydraulic system 44 can be used to drive hydraulic motor 62, which in turn drives the separator 52. The speed of the separator 52 can be variably adjusted to process more or less excavated material by changing the speed of the drive hydraulic motor 62. The hydraulic motor 62 is preferably reversible so that the separator 52 can be moved forward or backward on the rollers. Thus, if the separator 52 becomes clogged with excavated material, which may sometimes occur when the material is excessively wet, moving the separator 52 in the reverse direction can help unclog the separator 52.

The tension roller 56 is mounted to a support arm 66 on each of the side frame members 24 and 26. The support arm has a slot-like opening 68 therein so that the position of the tension roller 56 can be adjusted forward or rearward along the length of the slot-like opening 68. This allows the separator 52 traveling over the rollers 54, 56, 58, and 60 to be adjusted to the desired tension.

As shown in FIG. 3, the separator 52 travels in an endless path around the rollers 54, 56, 58, and 60. During normal operation, the separator 52 is operated so that it travels in a generally counterclockwise direction from the perspective shown in FIG. 3. As a portion of the endless separator 52 moves from the forward, lower roller 60 at an inclined angle to the horizontal ground level up to the drive roller 54, excavated material 50 at the forward end of the padding machine is carried upwardly and rearwardly on the separator 52.

However, it is to be understood that the padding machine 10 could have other configurations, for example, rather than supporting the separator at an angle as shown in FIG. 3, a separator can be supported to travel in a generally circular path. A shaker assembly 70 is mounted to the side frame members 26 and 28 adjacent the upper portion of the separator 52 as it travels between the forward, lower roller 60 and the drive roller 54. The shaker assembly 70 is positioned on the side frame members 26 and 28 to shake the frame members, which support the separator 52 and thus in turn shakes the separator. Vigorously shaking the frame members 26 and 28 dramatically increases the amount of fine padding material that can be separated from a given amount of excavated material moving on the separator 52.

According to the presently preferred embodiment of the invention, the shaker assembly 70 includes energy absorbing mounts 72 and 74, which are connected to both side frame members 26 and 28. The mounts 72 and 74 are preferably formed of a resilient rubber or rubber-like material to absorb some of the mechanical stress of the vibration imparted by the shaker assembly 70 to reduce the stress on the connections between the shaker assembly 70 and the rest of the padding machine 10. The rubber mounts 72 and 74 are bolted or otherwise fastened to the side frame members, with, for example, a plurality of bolts 76.

A support plate 78 is bolted or otherwise connected to the mounts 72 and 74, for example, with a plurality of bolts 80. A shaft support member 82 is integrally formed on the support plate 78. The shaft support member 78 is for supporting a rotating eccentric shaft as will be described in more detail with reference to FIGS. 4 and 5. A shaker hydraulic motor 84 is connected to side frame member 26 for driving the eccentric shaft. As shown in FIGS. 1–3, the hydraulic motor 84 is connected through hydraulic hoses 86 to the hydraulic system 44. Thus, the hydraulic system 44 can be used to drive hydraulic motor 84, which in turn drives the eccentric shaft to vibrate the separator 52. The speed of the shaker hydraulic motor 84 can be variably adjusted to increase or decrease the rotation speed of the eccentric shaft and the vibration produced. Thus, the shaker assembly 70 can be used to control the separation of more or less relatively fine material from the excavated material by changing the speed of the shaker hydraulic motor 84.

Figure 4:
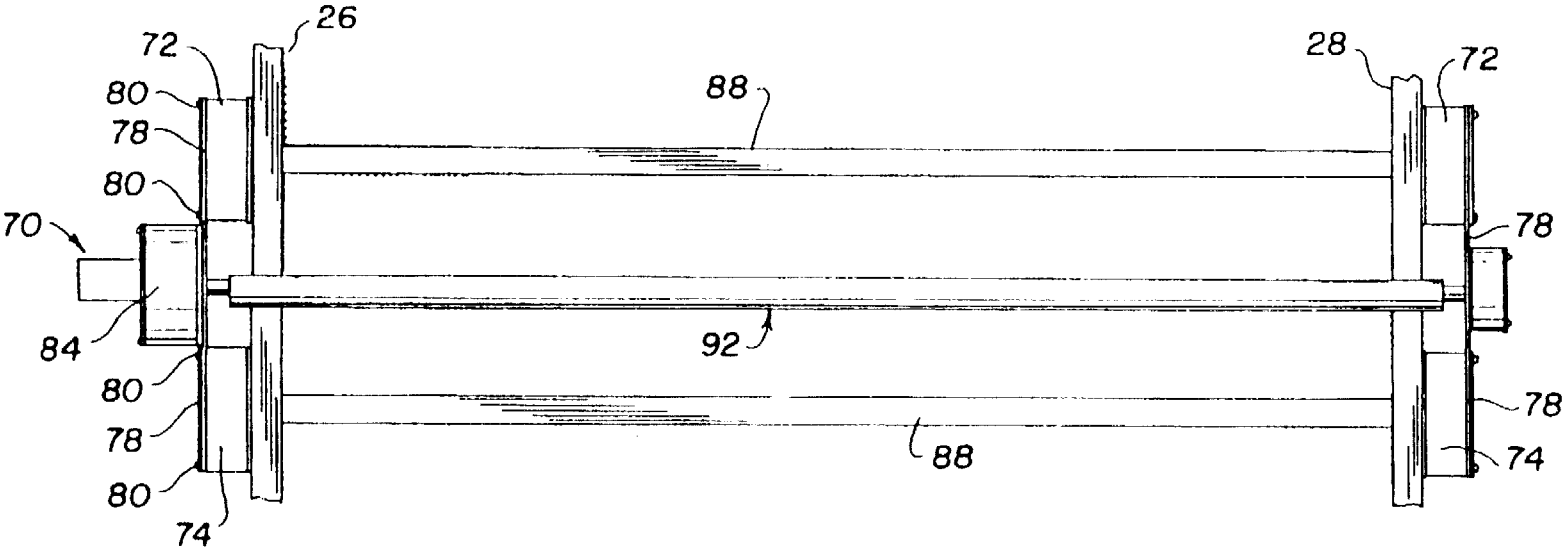
FIG. 4 is an upward looking view taken along lines 4—4 of FIG. 3 showing the shaker assembly as attached to the side frame members of the padding machine shown in FIGS. 1 and 2.
Figure 5:
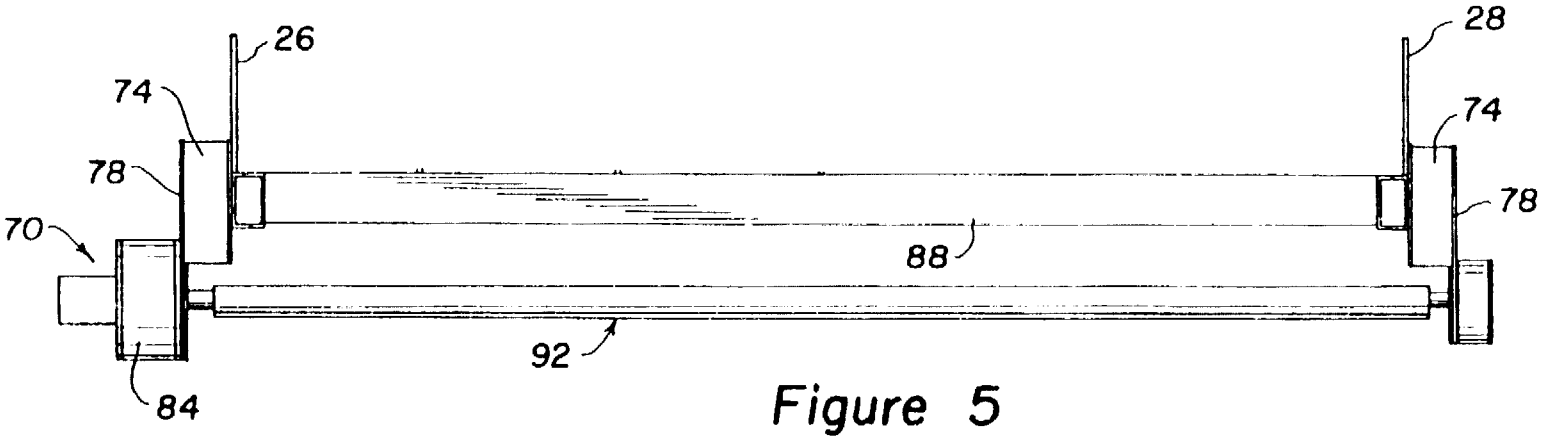
FIG. 5 is a front view of the shaker assembly shown in FIG. 4.

Turning now to FIGS. 4 and 5 of the drawing, FIG. 4 shows the view that can be seen looking upwardly through the shaker apparatus 70 from inside the padding machine 10. The separator 52 is not shown for clarity of the drawing. FIG. 5 shown the shaker apparatus 70 from the interior of the padding machine 10. a pair or cross-members 88 are positioned between the side frame members 26 and 28 to provide structural support to the padding machine 10. As can be seen in FIGS. 4 and 5, an eccentric shaft 92 is supported between the side frame members 26 and 28 by the shaft support members 78.

Figure 7:
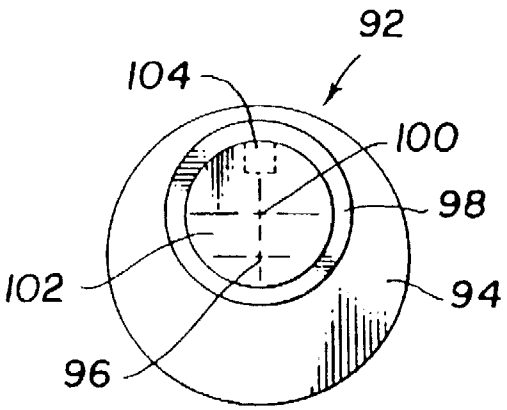
FIG. 7 is an end view of the drive end of the eccentric shaft of the shaker assembly shown in FIGS. 4–6.
Figure 6:
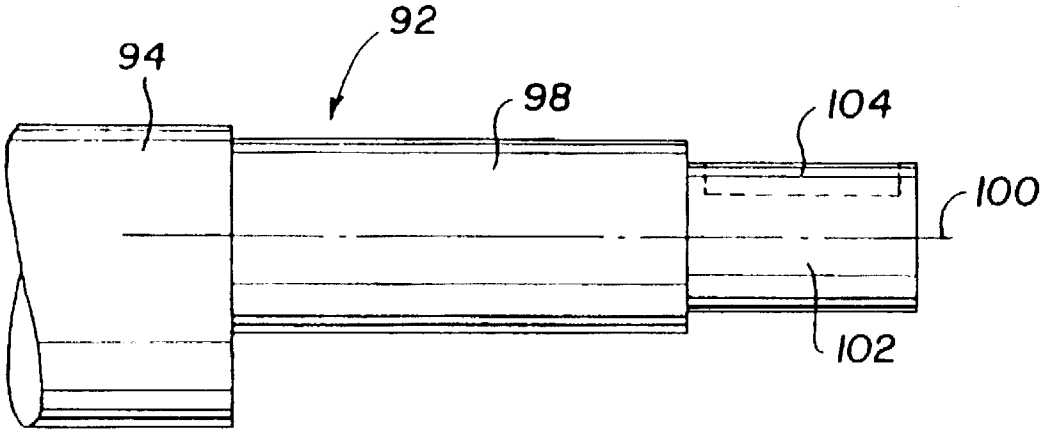
FIG. 6 is a side view detail of the drive end of the eccentric shaft of the shaker assembly shown in FIGS. 4 and 5.

Turning now to FIGS. 6 and 7, the structure and operation of the eccentric shaft 92 will be described in more detail. The drive end portion of the eccentric shaft 92 is shown in detail in FIG. 6, and an end view of the drive end portion is shown in FIG. 7. The eccentric shaft 92 has an elongated body portion 94 that is circular in cross-section and has a central axis 96 as best shown in FIG. 7. The drive end portion of the eccentric shaft 92 has a bearing portion 98, which is circular but smaller in cross-section than the body portion 94. The bearing axis 100 of the bearing portion 98 is off-center from the axis 96 of the body portion of the shaft 92. The other end of the shaft 92 (not shown) has a similar bearing portion 98. The bearing portion 98 defines a surface for the bearings that support the shaft to ride on, so that the shaft 92 can be rotated in the shaft support plate 78 by conventional means.

The drive end portion of the eccentric shaft 92 shown in FIGS. 6 and 7 has a key portion 102, which the other end of the shaft 92 does not require. The key portion 102 has a slot or notch 104 formed therein that can be engaged by the shaker hydraulic motor 84 to rotate the eccentric shaft 92. Thus, when the shaker hydraulic motor 84 rotates the shaft about the bearing axis 100 of the bearing portion 98 of the eccentric shaft 92, the body portion 94 is off-balance. Rapidly rotating the eccentric shaft 92 causes rapid vibration in the shaker assembly 70. The frequency of this vibration is controlled by varying the speed of shaker hydraulic motor 84.

The vibration caused by rotation of the eccentric shaft 92 is transferred through the rubber mounts 72 and 74 to the side frame members 26 and 28 and cross members 88 of the padding machine 10. The vibrating cross members support a plurality of longitudinal runners 90 as previously described, which in turn support the separator 52. Through these structural features, and under the weight of excavated material loaded onto the separator, vibration is imparted to the moving separator 52.

All else being about the same, the vigorous shaking of the separator 52 as it moves the excavated material dramatically increases the amount of the relatively fine padding material that passes therethrough. This means that a padding machine with a shaker assembly according to the present invention for the separator can be used to separate a greater amount of padding material from a given amount of excavated material, it can be used to separate a finer grade of padding material, or both. The increased productivity translates to lower operational costs to the cable or pipeline contractor.

The fine material that passes through the separator 52 is guided onto a discharge conveyor 120. The fine material can be guided to the discharge conveyor 120 by a chute, for example. Alteratively, the fine padding material can be guided by a secondary conveyor belt, such as the "inclined conveyor belt 42" disclosed in U.S. Pat. Nos. 5,097,610 and 5,261,171 issued to Bishop, which are incorporated herein by reference in their entirety.

The discharge conveyor 120 extends transversely with respect to the direction of travel of the padding machine 10. The discharge conveyor 120 is positioned directly beneath the upper end of the screening belt 52 to receive at least a portion of the fine padding material that passes through the screening belt 52. The discharge conveyor 120 has a conveyor belt 122 that travels on belt rollers 124 which are journalled to an elongated conveyor frame 126. a conveyor hydraulic motor 128, mounted within the elongated conveyor frame 126, drives the discharge belt 122. The conveyor hydraulic motor 128 is preferably reversible. The motor 126 is connected to the hydraulic system 44 through hydraulic fluid lines 130. The conveyor frame 126 rests on transverse support rails. The conveyor frame 126 and the discharge belt 122 may be slid in either direction on the support rails to be extendible from either side of the padding machine 10. This arrangement enables padding material to be selectively discharged into a ditch to either side of the padding machine 10. Thus, the padding machine 10 can be used to pad a cable or pipeline when traveling in either direction along either side of a ditch.

Figure 8:
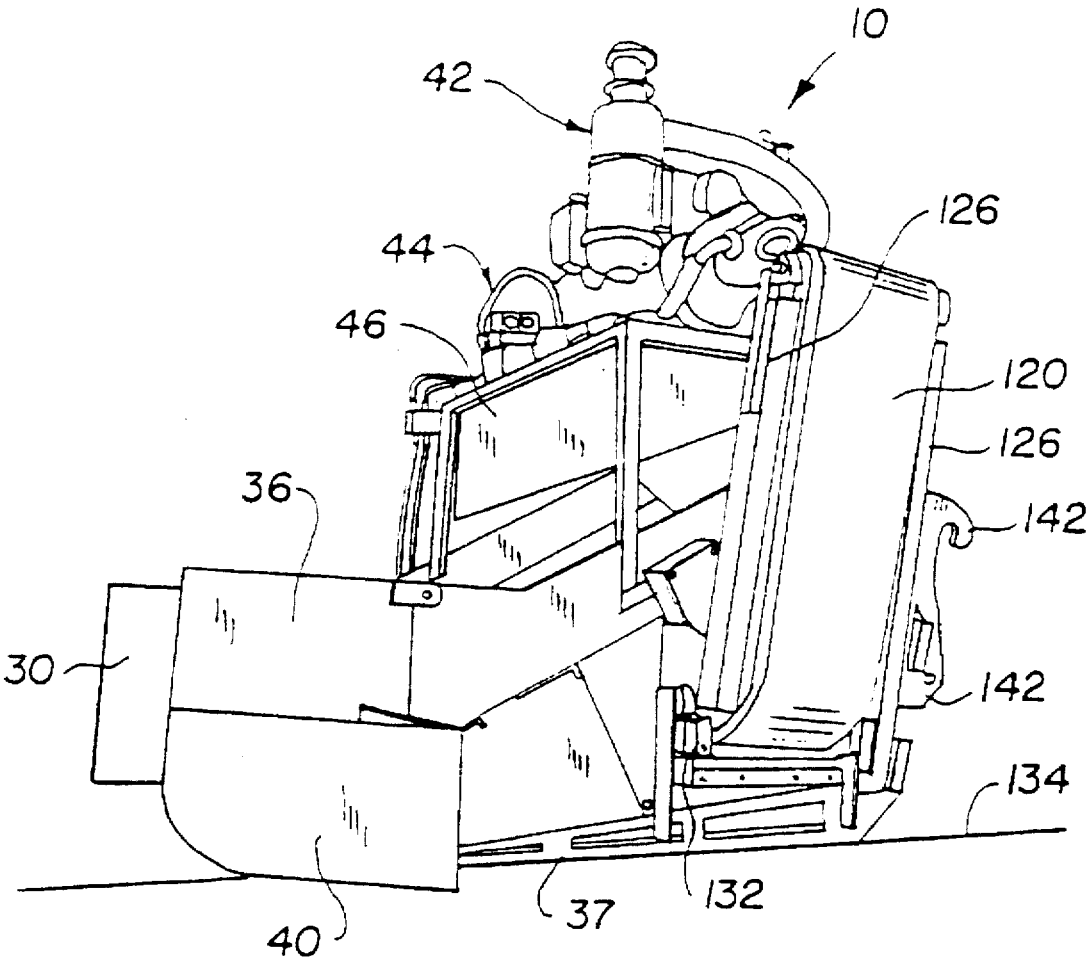
FIG. 8 is a perspective view of the padding machine removed from a vehicle and resting on a surface, such as the ground or the flat-bed of a truck, wherein the side conveyor is moved into a stowed positioned for transport.

Referring to FIG. 8 of the drawing, the discharge conveyor preferably has a central pivot connection 132 so that the extended portion can be raised to a stowed position as shown. Thus, when the discharge conveyor 120 is stowed vertically, the padding machine 10 is highly compact for storage or transport on a flat surface 134.

Continuing to refer to FIG. 8, the rear ends of the padding machine side frame members 26 and 28 each include ears 140, by which the padding machine 10 can be attached to the sub-frame 20 of a conventional loader 12 or other vehicle. The side frame members 26 and 28 also include hooks 142, by which the padding machine 10 can be engaged and supported by a bucket of a loader or bulldozer. The ears 140 or hooks 142 are adapted to receive the sub-frame of the vehicle 12 for removably and securely mounting the padding machine to the vehicle.

Turning back to FIGS. 1 and 2 of the drawing, the padding machine 10 preferably includes a remote control box 150, which is connected through an electrical line 152 to the engine 42 and hydraulic system 44 of the padding machine. When the padding machine 10 is connected to a vehicle 12, the remote control line 152 can be supported such that the remote control box 150 can be positioned inside the operator cab 18 of the vehicle 12. Thus, the operator can control every aspect of the padding machine from the cab 18. The control box 150 includes controls for the speed and direction of the hydraulic motor 62 for the screening belt 52, the speed of the shaker hydraulic motor 84 for rotating the eccentric shaft of the shaker assembly 70, and the speed and direction of the conveyor hydraulic motor 128 for the discharge conveyor 120.

In operation, the padding machine 10 is attached to the front end of a vehicle 12, a loader, for example, as shown in FIGS. 1 and 2. The padding machine 10 is preferably powered by its own diesel engine 42 and hydraulic system 44 mounted to the padding machine. Thus, the padding machine 10 can be operated independently of the hydraulic system of the vehicle 12, which facilitates the attachment and removal of the padding machine to and from the vehicle 12.

The padding machine 10 is positioned with the lower front end at ground level, and is normally driven along the ridge or earth, or berm, that is formed adjacent a trench by conventional trench digging equipment. The lip and the guide projections 30 and 32 collect the earth and guide it onto the screening belt 52. The wings 38 and 40 clear a path for the tracks or tires 16 of the vehicle 12.

As the earth is carried up the separator 52, relatively fine padding material passes through the vibrating separator 52, where it is directed or transported onto the transverse discharge conveyor 120. The discharge conveyor 120 transports the fine padding material to the nearby trench or ditch. Rocks and relatively rough residual material are carried to the top of the separator 52 and are discharged onto the ground behind the padding machine, preferably between the forward path of the tracks or tires 16 of the vehicle 12. Separator 52 thus performs both the functions of a separator and an elevating conveyor. Alternatively, rocks may be collected in a bucket behind the padding machine, or they may be conveyed to one side or the other by the auxiliary device described below, or they may be carried toward a bar to force rock to either side and down a chute (not shown).

The shaker assembly 70 serves to break up clods of soil and excavated material and thereby facilitate its passage through the separator 52. The shaker assembly 70 is particularly useful where excavated material is damp or wet. It also dramatically increases the amount of fine padding material that can be separated from a given amount of raw excavated material. Furthermore, the finer padding material obtained with the shaker assembly means better protection for the buried cable or pipeline.

Figure 9:
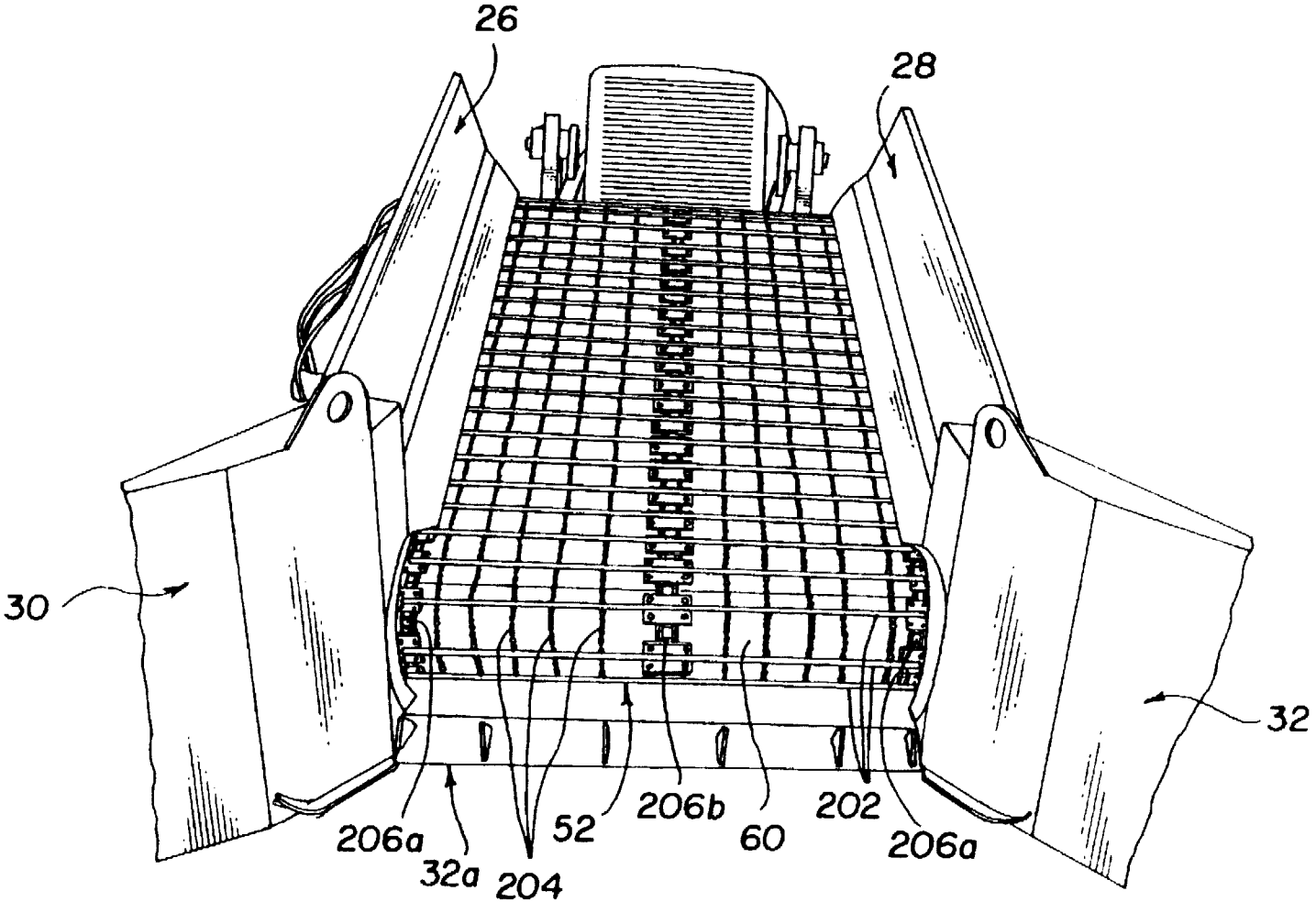
FIG. 9 is a front view of padding machine showing the presently most preferred embodiment of a chain separator according to the present invention, which is shown implemented in a padding machine attachment of the general type disclosed in U.S. Pat. Nos. 5,097,610 and 5,261,171 issued to Bishop.

The improved separator 52 according to the presently most preferred embodiment of the invention will now be described in detail. Referring now to FIG. 9 of the drawing, the improved separator 52 according to the presently most preferred embodiment of the invention is shown between the side frame members 26 and 28. The guide projections 30 and 32 project forward of the separator 52. a cutting blade **32*a* is preferably provided, the blade 32*a* extending between the guide projections 30 and 32 in front of the separator 52. As shown in FIG. 9, the separator 52 is partially supported on forward, lower roller 60**, as will hereinafter be described in detail.

As shown in FIG. 9, the separator 52 includes a plurality of rods 202, which extend horizontally between side frame members 26 and 28. While the rods can have square, rectangular, or other cross-sections, according to the presently most preferred embodiment of the invention, the rods 202 are solid cylindrical bars having substantially circular cross-sections. The rods 202 are strong and can withstand the impact of large, heavy rocks and other excavated material, providing more structural strength than a typical woven screen material of the same given spacing.

A plurality of chain link sections 204 are connected between the rods 202. The chain link sections 204 are preferably securely connected to the rods by welding. The chain link sections 204 are formed of several chain links. The chain link sections 204 are preferably longer than the spacing between the rods 202. Thus, the chain link sections 204 are flexible, and can sway between the rods. The flexible chain link sections 204 help prevent the buildup of clay or mud on the separator 52. The flexible chain links are especially susceptible to the vibratory energy imparted by a vibrator means, such as the previously described shaker assembly 70. As shown in FIG. 9 for a separator 52 of the endless openwork type, the chain link sections 204 are preferably welded to an inner side of the rods 202. For a flat separator for use in a padding machine of the type disclosed in self-contained padding machines such as those disclosed in the Lay et al. and Osadchuk patents discussed above, which use flat or inclined separator screens, the chain sections 204 are preferrably connected to the underside of the rods 202. This connection of the chain sections to the rods helps protect the welded connections from damage by larger rocks landing on the upper side of the separator 52 during the separating step of the padding process.

According to the presently most preferred embodiment of the invention, the separator 52 is formed into an endless openwork moving in a path around a plurality of rollers. According to this aspect of the invention, the plurality of rods 202 of the separator 52 are connected to drive chains, such as the two edge drive chains **206*a* and center drive chain 206*b*. The drive chains 206*a*–*c* are mounted and guided on sprockets of the rollers 54, 56, 58, and 60** as will hereinafter be described in detail. It is to be understood, of course, that additional or fewer than three drive chains can be used.

Figure 10:
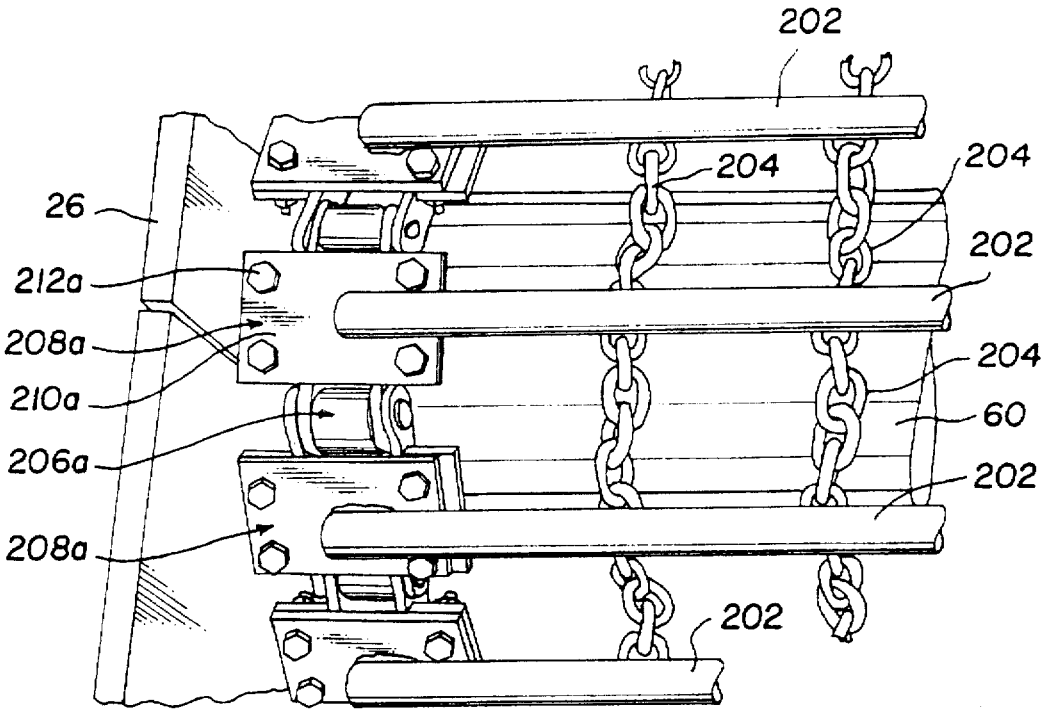
FIG. 10 is a detail view showing end mounting members for the rods of the chain separator shown in FIG. 9.

Referring to FIG. 10 of the drawing, a preferred embodiment of the connection of the rods 202 to left-side edge drive chain **206*a* is shown. In FIG. 10, the side frame member 26 and the forward, lower roller 60 are shown. The right end of each rod 202 is connected to an end rod mount 208*a*. Each end rod mount 208*a* is preferably a structural plate 210*a* adapted to be attached to the edge drive chain 206*a*. The end of a rod 202 is welded to the plate 210*a*. The plate 210*a* is provided with a plurality of apertures for mounting bolts 212*a*. The mounting bolts 212*a* are positioned through the apertures to engage with flanges on the edge drive chain 206*a* as will hereinafter be described in detail. It is to be understood, of course, that the other end of the rods 202 are similarly connection to the right-side edge drive chain 206*a***.

Figure 11:
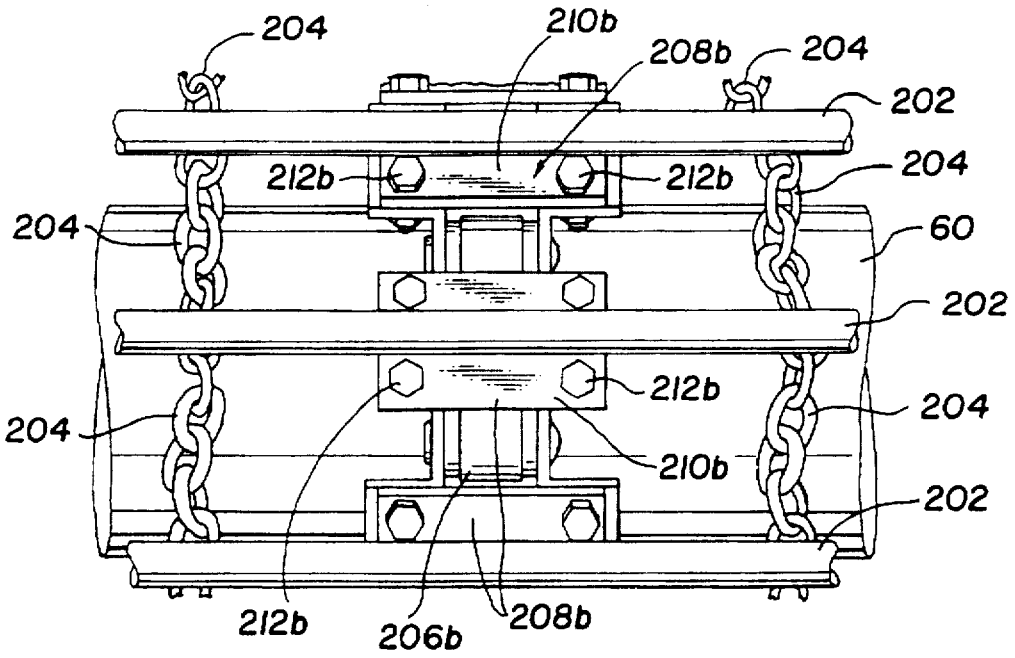
FIG. 11 is a detail view showing center mounting members for the rods of the chain separator shown in FIG. 9.

Referring to FIG. 11 of the drawing, a preferred embodiment of the connection of the rods 202 to center drive chain **206*b* is shown. In FIG. 11, the forward, lower roller 60 is shown. The central portion of each rod 202 is connected to a center rod mount 208*b*. Each center rod mount 208*b* is preferably a structural plate 210*b* adapted to be attached to the center drive chain 206*b*. The central portion of a rod 202 is welded to the plate 210*b*. The plate 210*b* is provided with a plurality of apertures for mounting bolts 212*b*. The mounting bolts 212*b* are positioned through the apertures to engage with flanges on the center drive chain 206*b*** as will hereinafter be described in detail.

Figure 12:
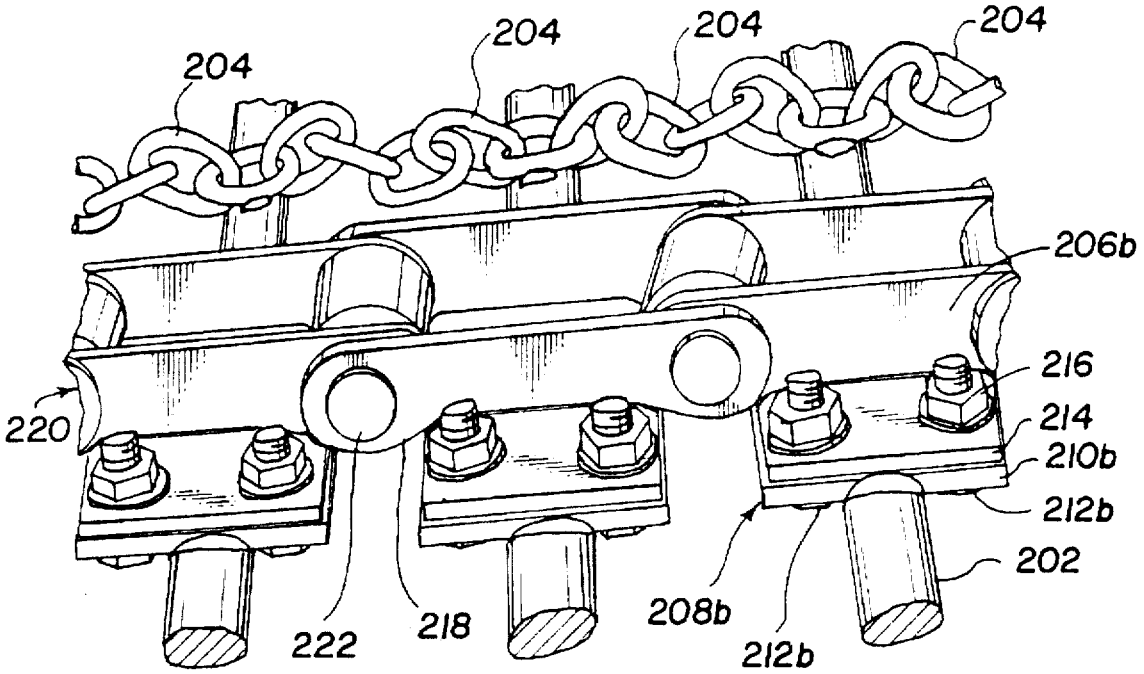
FIG. 12 is detail view showing the drive chain for the chain separator shown in FIG. 9.
Figure 13:
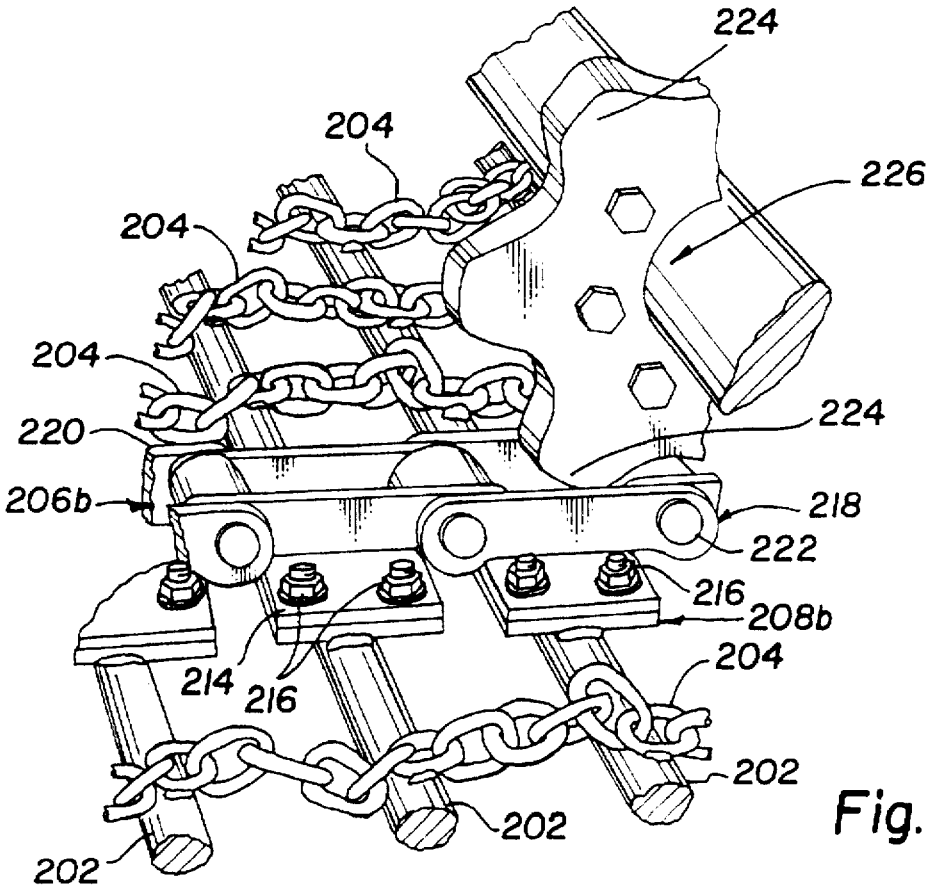
FIG. 13 is detail view showing the drive chain engagement with a guide sprocket of the padding machine according to the chain separator shown in FIG. 9.

Referring now to FIGS. 12 and 13, a preferred embodiment of the connecting a center rod mount **208*b* to a drive chain 206*b* is shown in detail. The apertures formed in the plate 210*b* of center rod mount plate 208*b* for bolts 212*b* correspond to similar apertures formed in flanges 214 attached to individual links of the drive chain 206*b*. Thus, when the plate 210*b* is aligned with a flange 214, bolts 212*b* can be placed through the apertures to connect the center rod mount plate 208*b* to the flange 214. Nuts 216 are used to secure the threaded bolts 212*b*. The end rod mounts 208*a* are similarly connected to drive chains 206*a***.

Continuing to refer to FIGS. 12 and 13 of the drawing, the drive chain **206*b*, which is representative of all three drive chains 206*a* and 206*b*, is of conventional roller chain design. For example, the drive chain 206*b* includes alternating roller chain links 218 and 220. Links 218 have a pair of parallel, spaced-apart leaves 218*a* and 218*b*, and links 220 have a similar pair of parallel, spaced-apart leaves 220*a* and 220*b*; however, the leaves of links 220 are closer together than the leaves of links 220. Each of the leaves has a pair of apertures at either end thereof. The apertures of the leaves 218*a* of links 218 are aligned with the apertures of the leaves 220***a* of links 220, whereby the links 218 and 220 are conventionally connected, end-to-end, by journal members 222. As shown in FIG. 13, the open space between the leaves and the journal members of each link is adapted to be captured upon the teeth 224 of a guide sprocket 226. A plurality of guide sprockets 226 are mounted to the rollers of the padding machine 10 for guiding the drive chains 206*a* and 206*b* thereon.

Figure 14:
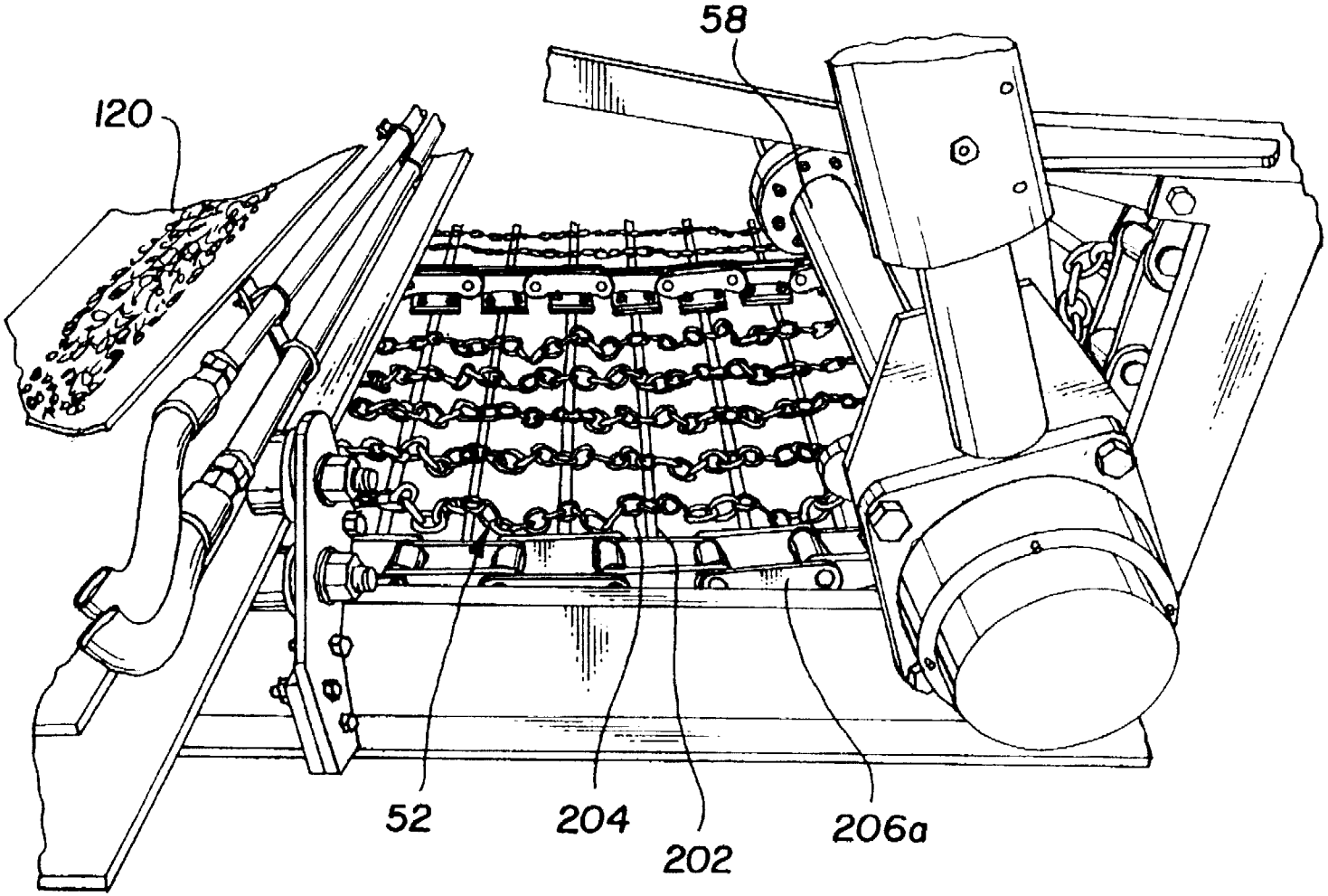
FIG. 14 is a view of a portion of the chain separator according to FIG. 9, when the portion is beneath the discharge conveyor belt of the padding machine.

Referring now to FIG. 14 of the invention, a particular advantage of the separator 52 is illustrated when it is used in padding machine having an endless openwork separator of the type described herein. FIG. 14 shows a portion of the separator 52 as it is moving adjacent roller 58 and beneath the discharge conveyor 120 of the padding machine 10. At this position in the endless path around the rollers, the chain sections 204 are positioned above the rods 202. The flexible chain sections 204 fall downward under the force of gravity. Any clay or mud is dislodged from the chain sections 204 during the motion of the flexible chain sections. Thus, the flexible chain sections 204 are much less likely to become clogged with clay or mud than a rigid separator screen. According to the invention, the flexible chain sections 204 resist the build up of clay and mud.

Furthermore, the separator 52 is much easier to repair than an interwoven strips or bars of a conventional separating screen. For example, if a rod 202 becomes bent or damaged by an unusually heavy rock, it can be repaired relatively quickly on site. The chain sections 204 adjacent the bent rod 202 are cut, and the bolts 212*a* and 212*b* connecting the rod mounts to the drive chains 206*a* and 206*b*, respectively, are removed. A replacement rod 202' is positioned and aligned with the flanges 214 of the drive chains 206*a* and 206*b*, and the bolts 212*a* and 212*b* positioned through the aligned apertures. Each bolt is secured with a nut 216. Replacement chain sections are welded into position, and the padding machine 10 is ready for use.

Accordingly, the separator 52 according to the invention is most advantageously adapted for use with padding machines having endless openwork separators of the type disclosed in U.S. Pat. Nos. 5,097,610 and 5,261,171 to Bishop, the disclosures of which are incorporated herein by reference in their entirety.

The separator according to the present invention can also be advantageously used in a padding machine attachment of the general type disclosed in U.S. Pat. No. 5,084,991 issued to Cronk, Jr. on Feb. 4, 1992, the disclosure of which is incorporated herein by reference in its entirety. In such an embodiment of the invention, the side walls of the padding machine are substantially rectangular, the separator is mounted on a rotating drum and is drum-shaped to travel in an endless path that is substantially circular, and the endless circular openwork of the separator has a plurality of flights mounted thereabout for lifting excavated material as the drum rotates the separator. According to this embodiment of the invention, the plurality of flights are preferably arcuate scoop members for lifting excavated material.

It also is to be understood that the improved separator assembly disclosed herein can be used in self-contained padding machines such as those disclosed in the Lay et al. and Osadchuk patents discussed above, which use flat or inclined separator screens. However, when used with a flat separator member, a shaker or vibrator means is necessary to vibrate the separator so that relatively fine padding material is separated from excavated material moved thereon.

Figure 15:
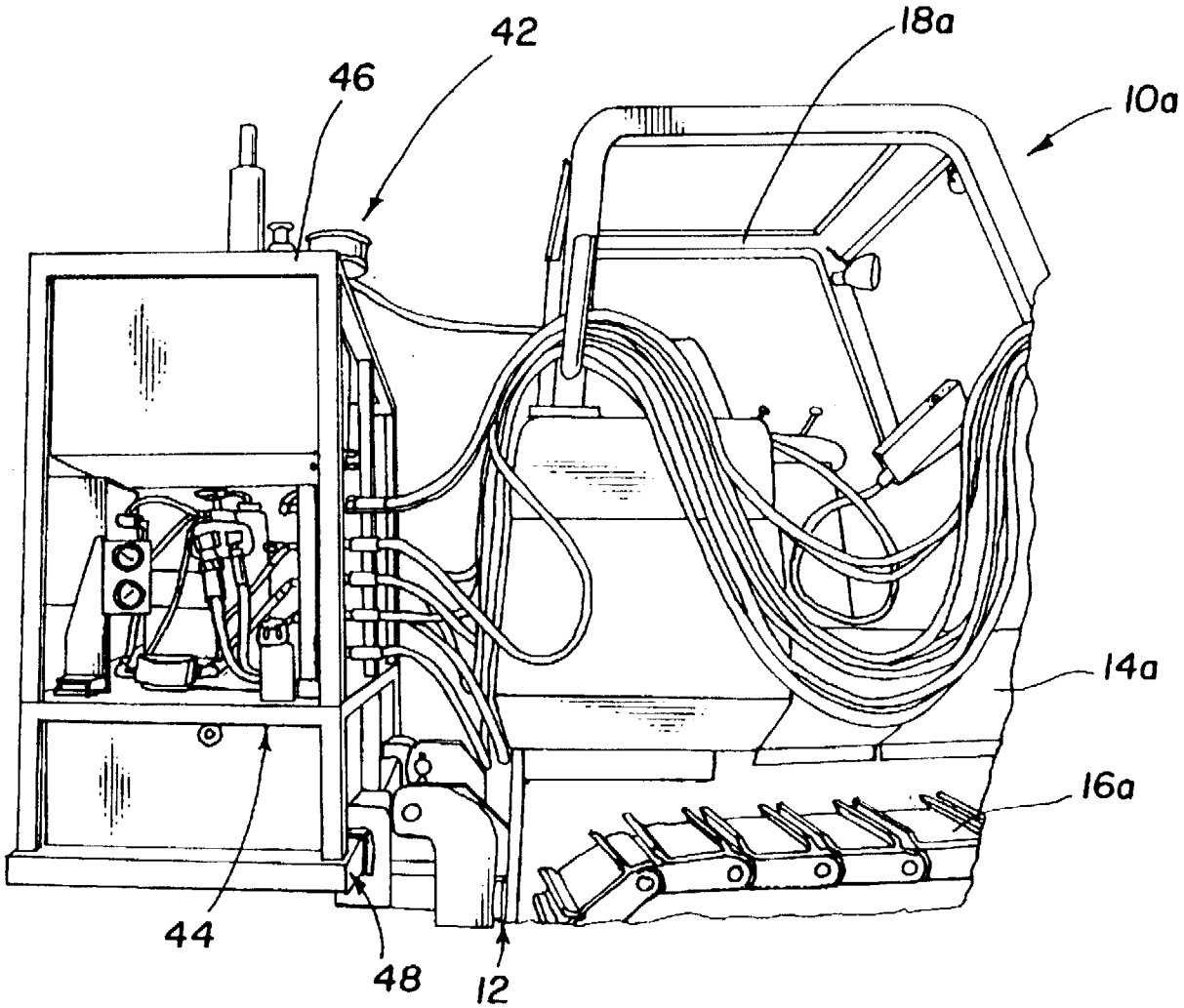
FIG. 15 shows an alternative embodiment according to the invention, wherein the hydraulic system is separately mounted to the rear of the vehicle.

Referring to FIG. 15 of the drawing, an alternative embodiment of a padding machine, generally referred to by the reference numeral 10*a* is shown. In this embodiment, the vehicle or prime mover for the padding machine 10*a* is most preferably dozer 12*a*. The dozer 12*a* has a base frame 14*a*, tracks 16*a*, and an operator cab 18*a*. According to this embodiment of the invention, the diesel engine 42, hydraulic system 44, and hydraulic reservoir 46 are housed in a separate frame 48*a*. The frame 48*a* is adapted to be removably mounted to the rear end of the dozer 12*a*. Thus, the weight of the diesel engine 42, hydraulic system 44, and hydraulic reservoir 46 help counterbalance the frame 24 and separator 52 mounted to the forward end of the dozer 12*a*.

Although the invention as described with reference to these preferred embodiments, other embodiments can achieve the same results. Variations and modifications of the present invention will be obvious to those skilled in the art, and it is intended to cover in the appended claims all such modification and equivalents.

Having described the invention, what is claimed is:

1. A padding apparatus for padding underground cable or pipeline by continuously separating excavated material piled alongside an excavated ditch into relatively fine padding material and relatively rough residual material as the apparatus moves forward and placing the relatively fine padding material in the ditch, the apparatus comprising: a frame for supporting and moving an endless openwork in an endless path for lifting excavated material in an elevating direction, said endless openwork having rods and transverse chain sections attached to said rods, whereby said rods and chain sections define openings that allow relatively fine padding material to pass therethrough; a discharge conveyor positioned to receive the relatively fine padding material and convey the padding material to the ditch for padding cable or pipeline therein.

2. A padding apparatus according to claim 1, further comprising: a shaker assembly for shaking said frame to increase the amount of fine padding material that passes through said openwork.

3. A padding apparatus according to claim 2, wherein said shaker assembly has resilient mounts for mounting an eccentric shaft to said frame adjacent a portion of said endless openwork and a motor for rotating said eccentric shaft to cause vibratory motion that is translated through said resilient mounts to said frame and said endless openwork.

4. A padding apparatus according to claim 3, wherein the length of said eccentric shaft is substantially the width of said endless openwork and wherein said shaft is positioned to extend across the width of said endless openwork below an elevated portion of said endless openwork.

5. A padding apparatus according to claim 1, wherein said frame has forwardly extending guide projections thereon for guiding excavated material to said endless openwork as the apparatus moves forward relative to the pile of excavated material.

6. A padding apparatus according to claim 1, wherein said frame has mounting means for attaching the apparatus to a prime mover for moving the apparatus relative to the pile of excavated material alongside the ditch.

7. A padding apparatus according to claim 1, further comprising a prime mover for moving said frame relative to the pile of excavated material alongside the excavated ditch.

8. A padding machine according to claim 1, wherein said frame comprises: a pair of side frame members connected by cross members.

9. A padding machine according to claim 8, wherein at least one of said side frame members has an opening through which said discharge conveyor extends, whereby padding material is transported through said at least one side frame member to the ditch.

10. A padding machine according to claim 9, wherein said side frame members are triangular and said endless openwork travels in a path that includes an upwardly inclined portion.

11. A padding machine according to claim 10, further comprising an inclined conveyor supported by said frame and positioned at least partially beneath the inclined portion of said endless openwork, whereby padding material that is passed through said inclined portion of said endless openwork is carried upwardly and transferred to said discharge conveyor.

12. A padding machine according to claim 9, wherein said side frame members are rectangular, said endless openwork is drum-shaped and travels in a path that is substantially circular, said endless openwork having a plurality of flights mounted thereabout for lifting excavated material.

13. A padding machine according to claim 12, wherein said plurality of flights are arcuate scoop members for lifting excavated material.

14. A padding machine for attachment to a sub-frame of a prime mover for moving with the prime mover along one side of a ditch to pick up at least a portion of a pile of excavated material placed parallel to and along the one side of the ditch and processing the excavated material into padding material for placement in the ditch, the padding machine comprising: a frame; coupler for releasably connecting said frame to the sub-frame of the prime mover whereby the sub-frame can raise and lower the padding machine to control the amount of excavated material processed by the padding machine; an endless openwork mounted to said frame for moving in an endless path, said endless openwork having rods and transverse chain sections attached to said rods, whereby said rods and chain sections define openings that allow padding material to pass therethrough, said endless openwork lifting excavated material and separating the lifted excavated material into padding material and rough material by passing padding material through said openwork; and a discharge conveyor mounted to said frame whereby it receives padding material passed through said endless openwork and transports the padding material for placement in the ditch.

15. A padding machine according to claim 14, further comprising: vibrating means for vibrating said endless openwork, whereby the amount of padding material passing through said endless openwork is increased.

16. A padding machine according to claim 15, wherein said vibrating means comprises: a shaker assembly resiliently mounted to said frame adjacent a portion of said endless openwork, said shaker assembly having a motor for rotating an eccentric shaft for vibrating said frame and said endless openwork.

17. A padding machine according to claim 16, wherein said eccentric shaft extends substantially the width of said endless openwork.

18. A padding machine according to claim 14, wherein said frame comprises: a pair of side frame members connected by cross members.

19. A padding machine according to claim 18, wherein at least one of said side frame members has an opening through which said discharge conveyor extends, whereby padding material is transported through said at least one side frame member to the ditch.

20. A padding machine according to claim 19, wherein said side frame members are triangular and said endless openwork travels in a path that includes an upwardly inclined portion.

21. A padding machine according to claim 20, further comprising an inclined conveyor supported by said frame and positioned at least partially beneath the inclined portion of said endless openwork, whereby padding material that is passed through said inclined portion of said endless openwork is carried upwardly and transferred to said discharge conveyor.

22. A padding machine according to claim 19, wherein said side frame members are rectangular, said endless openwork is drum-shaped and travels in a path that is substantially circular, said endless circular openwork having a plurality of flights mounted thereabout for lifting excavated material.

23. A padding machine according to claim 22, wherein said plurality of flights are arcuate scoop members for lifting excavated material.

24. A padding machine according to claim 18, further comprising forwardly extending guide projections on said side walls for guiding excavated material to said endless openwork as the padding machine moves forward relative to the pile of excavated material alongside the ditch.

25. A padding machine according to claim 24, wherein said guide projections have upwardly extending portions to prevent excavated material from spilling thereover.

26. A padding machine according to claim 24, wherein said guide projections have outwardly extending wings for clearing a path for the forward moving tracks or wheels of the prime mover.

* * * * *

UNITED STATES PATENT AND TRADEMARK OFFICE

CERTIFICATE OF CORRECTION

PATENT NO. : 5,741,087

DATED : April 21, 1998

INVENTOR(S) : Mark Osadchuk

It is certified that error appears in the above-identified patent and that said Letters Patent is hereby corrected as shown below:

In Column 3, line 50 change change the word "positioned" to - - position - -;

In Column 3, line 62 insert the word "a" before - - detail - -;

In Column 3, line 65, insert the word "a" before - - detail - -;

In Column 4, line 28, change the word "Lay" to - - Layh - -;

In Column 5, line 30, change the word "operating" to - - operation - - ;

In Column 5, line 61, change the word "the" to - - that - -;

In Column 6, line 33, start a new paragraph after "path."

In Column 7, line 10, change the word "shown" to - - shows - -;

In Column 7, line 11, the word "a" should be - - A - -;

In Column 8, line 12, the word "a" should be - - A - -;

In Column 9, line 36, the word "a" should be - - A - -;

UNITED STATES PATENT AND TRADEMARK OFFICE

CERTIFICATE OF CORRECTION

PATENT NO. : 5,741,087

DATED : April 21, 1998

INVENTOR(S) : Mark Osadchuk

It is certified that error appears in the above-identified patent and that said Letters Patent is hereby corrected as shown below:

In Column 10, line 2, change the word "Lay" to - - Layh - -;

In Column 10, line 47, delete the word "the";

In Column 11, line 12, before the word "padding" insert the word - - a - -;

In Column 11, line 26, delete the word "an";

In Column 11, line 60, change the word "Lay" to - - Layh - -.

Signed and Sealed this

First Day of September, 1998

*Attest:*

*Attesting Officer*

Bruce Lehman

BRUCE LEHMAN

*Commissioner of Patents and Trademarks*